US008183960B2

(12) United States Patent
Ligander et al.

(10) Patent No.: US 8,183,960 B2
(45) Date of Patent: May 22, 2012

(54) TRIMMING OF WAVEGUIDE FILTERS

(75) Inventors: Per Ligander, Göteborg (SE); Marcus Karl Hasselblad, Mölndal (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 457 days.

(21) Appl. No.: 12/373,541

(22) PCT Filed: Jul. 13, 2006

(86) PCT No.: PCT/SE2006/000881

§ 371 (c)(1),
(2), (4) Date: Jan. 13, 2009

(87) PCT Pub. No.: WO2008/008006

PCT Pub. Date: Jan. 17, 2008

(65) Prior Publication Data

US 2009/0289746 A1 Nov. 26, 2009

(51) Int. Cl.
*H01P 7/06* (2006.01)

(52) U.S. Cl. ..... 333/202; 208/219.1

(58) Field of Classification Search ..... 333/202, 333/208, 209, 219.1, 235
See application file for complete search history.

(56) References Cited

U.S. PATENT DOCUMENTS

| | | | | |
|---|---|---|---|---|
| 4,041,421 | A * | 8/1977 | Owlett | 333/209 |
| 5,349,316 | A * | 9/1994 | Sterns | 333/208 |
| 5,589,807 | A | 12/1996 | Tang | |
| 5,990,767 | A * | 11/1999 | Ivanov et al. | 333/219.1 |
| 7,026,893 | B2 * | 4/2006 | Kim et al. | 333/219.1 |

FOREIGN PATENT DOCUMENTS

| | | | |
|---|---|---|---|
| JP | 5110310 | A | 4/1993 |
| WO | WO 2006/058965 | A1 | 6/2006 |

* cited by examiner

*Primary Examiner* — Seungsook Ham

(57) ABSTRACT

A waveguide filter comprising a matching means for matching the filter. The waveguide filter comprises a housing comprising a cavity having a predetermined first volume. The matching means is in the form of a volume element having a predetermined second volume being matched to the first volume forming a predetermined volume to volume ratio. The matching means is fitted into the cavity in a fixed non-adjustable manner in relationship to the housing. The invention refers also to a method for manufacturing of such a waveguide filter.

12 Claims, 3 Drawing Sheets

TRIMMING OF WAVEGUIDE FILTERS

TECHNICAL FIELD

The invention refers to a waveguide filter comprising a matching means for trimming the filter. The waveguide filter comprises a housing comprising a cavity having a predetermined first volume. The matching means is in the form of a volume element having a predetermined second volume being matched to the first volume forming a predetermined volume to volume ratio. The invention also refers to a manufacturing process of said waveguide filter.

BACKGROUND

In the field of waveguide filters it is known to use a housing comprising a bottom portion, a top portion and side portions connecting the bottom portion and the top portion. The housing comprises an input port (also called an iris) for receiving an input signal and an output port for transmitting an output signal. The filter receives the input signal and filters the input signal from certain frequencies and forwards the filtered signal as the output signal to a transmitting unit or transmits the output signal itself. The housing is designed dependent on the filter type, for example a band-pass filter or a low-pass filter. However, common for all filters are that the housing comprises one or more cavities which together with corresponding trimming means is designed for filtering the input signal. The trimming means are in the form of one or a number of movable bodies corresponding to the number of cavities. U.S. Pat. No. 5,349,316 teaches the use of movable bodies in the form of trimming plungers or trimming screw.

U.S. Pat. No. 4,041,421 teaches the use of movable bodies in the form of screws being rotatably mounted in the top portion and each screw protrude into one of said cavities. It is long known that the volume of a trimming means body in the cavity is essential for the filter behaviour. Therefore, when trimming the filter a predetermined input signal is fed to the filter whereafter the output signal is measured while the screws are screwed into or out from the cavities until a predetermined and desired output signal pattern is achieved.

The need for the use of trimming means is to adjust the operating frequency of the filter to meet a desired frequency characteristic. The trimming means is either screwed into or out from the cavity in order to change the capacitance of the waveguide filter. The trimming is necessary because the position of the trimming means in the cavity and the material of both the trimming means and the waveguide filter affects the capacitance. Furthermore, lack of dimension accuracy giving cavities non-predictable sizes also gives a need for adjusting the trimming means in order to compensate for the differences in order to get a number of filters to perform identically to another for the same filtering purpose. Hence, every prior art waveguide filter have to be trimmed after assembly which is a time consuming process step and therefore also a costly part of the manufacturing.

One problem with using screws is that the size of the housing decreases with the increase in frequency and for frequencies above 20 GHz the housing is so small that the screws, the holes for the screws and the threads for the screws become so small that the process of manufacturing the same is difficult and costly. In addition to this problem, the small sized screws are hard to handle because of their smallness and the trimming of the filter becomes difficult and costly.

Thus, there exists a need for an improved waveguide filter being easier and cheaper to manufacture.

SUMMARY

The invention intends to remedy the above mentioned disadvantages and the object is to produce a waveguide filter being easier and cheaper to manufacture.

The object is met by the invention referring to a waveguide filter comprising a matching means for trimming the filter. The waveguide comprises a housing comprising a cavity having a predetermined first volume. The matching means is in the form of a volume element having a predetermined second volume being matched to the first volume forming a predetermined volume to volume ratio. The invention is characterised in that the matching means is fitted into the cavity in a fixed non-adjustable manner in relationship to the housing.

Here, "fixed" refers to the matching means being permanently attached to a surface belonging to the housing or the wall. Furthermore, "non-adjustable" refers to the matching means having a predetermined second volume that cannot be changed when the matching means has been fixed in the cavity.

The invention refers also to a method for manufacturing the waveguide filter and comprises the steps of:

- manufacturing the housing separate from the matching means (2);
- forming the housing to comprise a cavity having a predetermined first volume;
- forming the matching means in the form of a volume element having a predetermined second volume being matched to the first volume forming a predetermined volume to volume ratio;

The invention is characterised in that the method comprises the step of fitting the matching means into the cavity in a fixed non-adjustable manner in relationship to the housing.

One benefit of the invention is that the predetermined housing and predetermined matching means gives the possibility to manufacture all parts separately with a high degree of repetition accuracy whereafter the waveguide filter is assembled by attaching the matching means in the cavity in a predetermined position relative the housing. Hence, a number of waveguide filters with predetermined performance may be manufactured without having to trim every waveguide filter after assembly. The manufacture therefore becomes simple and cheap and allows for rapid changes in the production line with regard to different demands on the filter. For example if the production line produces waveguide filters with a predetermined bandwidth and a demand for a waveguide filter with different bandwidth characteristics occurs, this demand may be met bay simply changing the matching means used to a pre-fabricated matching means giving a different volume to volume ratio and thereby changing the bandwidth characteristics accordingly.

Further advantages of the invention will be explained below in the detailed description of the invention.

DETAILED DESCRIPTION OF THE INVENTION

The below described embodiments are all different options for the invention and may be combined within the scope of the appended independent claims.

In one embodiment of the invention, the housing only partly encompasses the cavity. The housing is mounted onto a conductive surface of a carrier forming a wall closing the cavity. The enclosed cavity comprises the predetermined first volume, and the second volume is matched to the first volume forming a predetermined volume to volume ratio. The matching means is fitted into the cavity in a fixed non-adjustable manner in relationship to the housing and the wall.

Here "partly encompassing a cavity" refers to a three dimensional structure having one open side. The housing is formed such that the open side comprises a peripheral edge peripherally surrounding the cavity and intended to face the carrier surface. The peripheral edge has an extension in a plane and is intended to be mounted onto the conductive surface having an extension in the same plane. The carrier surface thus forms the above mentioned wall against the peripheral edge and thus closes the cavity upon application of the housing onto the carrier.

One benefit of this embodiment is that the carrier surface easily can be manufactured in a predetermined and precise manner by known methods and that the housing may be positioned and attached to the carrier surface in a precise manner. Further advantages of this embodiment will become apparent below.

The carrier may be made from a number of materials, but a cost efficient choice is the use of a plastic material which is known from circuit boards. The carrier surface advantageously comprises a metal layer coated onto the carrier. The metal layer may be formed by, for example, etching into a shape corresponding to the peripheral edge of the housing. The housing is advantageously attached directly onto the metal layer by a suitable attachment method. One especially advantageous attachment method is soldering because the shape of the metal layer corresponds to the shape of the peripheral edge of the housing such that the liquid soldering material automatically aids in the positioning of the housing due to surface tension phenomena.

The matching means is designed dependent on a number of parameters, for example choice of material, position in the cavity and shape, and other parameters having an impact on the signal to be processed. The second volume therefore differs dependent on all the parameters and has to be chosen accordingly. However, the benefit of the invention lies in the possibility to use the parameters and the first volume in order to predict the second volume and that the process of assembling the waveguide filter therefore becomes simple and flexible.

The housing may have any suitable form for wave-guiding and may comprise complex features and details that affect waves travelling within the housing. The housing may have a pyramidal form, i.e. a squared base with decreasing square sections on top of each other starting from the base and a top wall being planar with the peripheral side edge of the square base. The cavity thus has a corresponding shape with stepwise decreasing inner walls from bottom to top. Other shapes are also possible, but the lowest common denominator is that the housing has precise dimension characteristics suitable for generating a standing wave. The precise dimension characteristics may be achieved by moulding the housing in a suitable material, for example plastics or zinc or the like and then plating the material with an electrically conduction material such as gold, silver, cupper or the like.

One advantage of the invention lies in that the predetermined first and second volume gives a simple and flexible manufacturing process where a separate matching means is chosen for a certain housing and carrier when it is time for assembly. The great benefit of the invention is that different batches may be manufactured with different dimensions of the housing, the carrier and the matching means. Each batch comprises a number of essentially identical housings, a number of essentially identical walls (i.e. carrier surfaces) and a number of essentially identical matching means all which may be manufactured separately giving a low cost because the same casting mould or the same tool may be used for manufacturing a great number of the essentially identical devices in each batch. Another cost benefit is due to the fact that the waveguide does not have to be trimmed as the previously known waveguide filters. The previously known trimming means is in the form of trimming screws, or the like, that has to be adjusted after assembly of the waveguide. The adjustment is time consuming and therefore costly. The invention, on the contrary, does not have to be trimmed but everything is predetermined on assembly. The flexibility of the invention lies in that, for example, an operator may build different waveguide filters by choosing the appropriate items from the different batches and then assembly them in an easy and cost-efficient way without the need for trimming.

In one preferred embodiment of the invention the matching means is directly attached to the carrier surface. One advantage of this embodiment is that the housing and the carrier may be manufactured independently of the matching means as long as the housing and the conductive carrier surface are manufactured with a high degree of repeated dimensional accuracy, i.e. that a series of housings and a series of carrier surfaces respectively are essentially identical for a certain predetermined frequency. The independent manufacturing of the housing and the carrier surface gives two key components that may be used together with different matching means. Preferably, the soldering method described above is used where the matching means is positioned onto the carrier surface in a predetermined position and where the soldering material automatically centres the matching means in its predetermined position.

The matching means are also manufactured independently with different volume dimensions and with a high degree of repeated dimensional accuracy. This gives the advantage that the same housing and carrier may be used for different filters by simply attaching different matching means to the carrier surface depending on the desired volume to volume ratio. As stated above the volume to volume ratio gives the operating parameters for the filter.

When manufacturing the housing, the batches of housings may be controlled by a random pick of housings from the batch whereafter the housings are tested without the matching means. The testing is performed by transmitting a known signal into the housing and measuring the signal on exit from the housing. The testing reveals information on the housings ability to generate standing waves and in what frequencies. The batch may then be labelled accordingly and may be matched with a suitable matching means with a predetermined second volume for production of a waveguide filter with predetermined features. This differs from prior art since the present invention allows measurements on only a few housing in order to get a large number of waveguide filters, but in prior art every waveguide filter has to be trimmed since the trimming means in prior art do not have a predetermined second volume, but the second volume is experimentally matched to the first volume by hands on trimming after assembly.

According to one embodiment of the invention, the matching means is in the form of a separate solid object being attached to the carrier surface via attachment means. The attachment means may be in the form of glue or a solder material such as, for example, led or tin. The attachment means is advantageously in a fluid state and positioned on the carrier surface. The matching means is thereafter positioned on the fluid attachment means. The fluid state of the attachment means has the advantage that surface tension phenomena affects the matching means in such a way that the matching means is centred with regard to the lateral extent of the attachment means. When positioning the attachment means, a positioning means may be used for delimiting the fluid attachment means to a certain area. The positioning means thus hinder the liquid from exiting a predetermined area.

The positioning means is preferably in the form of a circular ring that hinders the fluid attachment means from exiting the area and the circular form also helps to distribute the attachment means evenly within the area. The positioning means have another shape than circular, for example square, rectangular, oval or the like, as long as it is possible to predict the position of the matching means with regard to the shape of the positioning means.

The positioning means may be in the form of a solder stop when using a soldering method, and may be in the form of a tape strip or anything similar that may hinder the liquid from exiting the area. If the positioning means builds substantial volume, the positioning means also has to be taken into consideration when calculating the second volume.

When the matching means is positioned and centred, the attachment means is solidified. The solidification may be achieved by cooling down a hot attachment means, for example, when soldering or a when using a hot adhesive. The solidification may also be achieved by use of a non-heated adhesive that solidifies after a certain time period due to its composition, or that may be solidified by use of an external means, for example, an ultraviolet lamp etc. The attachment means has to be taken into consideration when calculating the second volume since the attachment means builds volume unless the attachment means has a thickness greater than zero.

The advantage of this embodiment lies in that the matching means can be manufactured with different second volumes as long as the surface of the matching means intended to be attached to the carrier surface has the same size for all volumes. The benefit of being able to switch between matching means having different second volumes has been explained above and will be further explained below.

According to another embodiment, the matching means is in the form of a separate solidified object being attached to the carrier by the solidified object being formed onto the carrier in liquid form and then being solidified. A positioning means may be used for this embodiment too for the reasons stated above. The advantage of this embodiment is that the dimension, i.e. volume, of the matching means may be decided in situ when the matching means is to be attached to the carrier by adding different amount of liquid material to the target area. This embodiment thus has the same advantages as the above mentioned embodiment with a solid object attached by attachment means and solves the stated problem of a more efficient manufacturing of a waveguide filter.

The liquid material may be a solidifiable adhesive such as a two-component glue or plastic that solidifies after a predetermined time period due to composition itself. The liquid material may also be a material that solidifies after being treated by an external source, for example ultra violet light or laser or microwave or any other suitable external source. Examples of such materials are a number of different plastics, rubber, ceramics and the like.

The non-conductive materials may be made, at least partly, conductive by addition of a suitable electrically conductive material. The reason for using an electrically conducting material is that it minimises the losses in the waveguide filter. The non-conductive materials have different dielectric properties which affect the wave to be processed and therefore affect the second volume such that the greater the dielectric constant the lesser the second volume.

The liquid material may also be in the form of a metal that has been liquefied by, for example, heating. The liquid metal solidifies when it has been cooled down to a temperature specific for the metal in question. The metal may be in the form of, for example, tin, silver, gold, led, zinc, cupper, etc. and suitable combinations of the metals, both as alloys and in the form of plating. One example of a suitable layer structure in a matching means is the use of plastic forming the main part of the volume and a metal plating on the solid plastic surface. The metal may be any suitable metal, for example cupper, silver or gold. A combination of zinc and cupper is also a feasible solution giving the stated advantages. Furthermore The solidified material may have a dome shape or any other shape that comes natural in a solidification process in a system affected by gravity. Please note that gravity is not a prerequisite for the process, but is only the most normal environment in a manufacturing plant. Hence, the process may be done in a non-gravity environment with a different shape of the solidified matching means as a consequence.

The matching means may also be built from a number of solidified layers. when one layer has been solidified the next layer is applied onto the solidified layer and so on until the matching means has been shape. One advantage of this embodiment is that the shape of the matching means may be modelled into a desired shape by altering the height and width of each layer.

According to one embodiment of the invention the matching means is fixed in the cavity by being directly attached onto an inner surface of the housing. Any of the above described methods may be used and the above stated advantages of the invention using predetermined volume to volume ratio are achieved. However, the process of attaching the matching means in the housing is somewhat more complicated than the attachment onto the surface of the carrier, why the latter alternative is a better alternative with regard to the manufacturing process.

The inventive waveguide filter may advantageously be used in a front end branching unit for microwaves and as a filter in a chain of signal processing and a number of other previously known fields.

BRIEF DESCRIPTION OF THE DRAWINGS

The invention will below be explained in view of a number of drawings where.

DESCRIPTION OF PREFERRED EMBODIMENTS OF THE INVENTION

Figure 1:
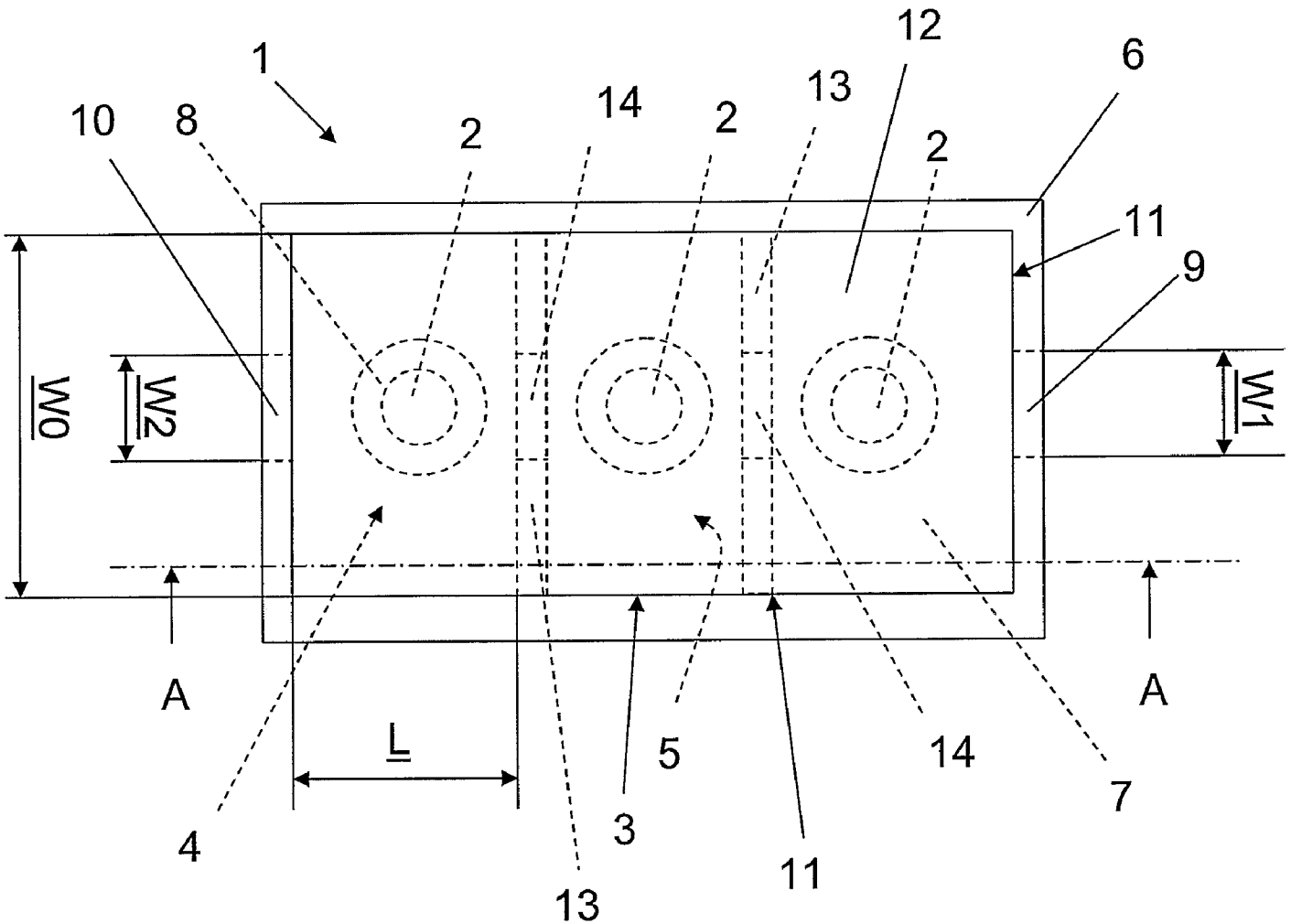
FIG. 1 schematically shows a top view of a waveguide filter according to the invention.

FIG. 1 schematically shows a top view of a waveguide filter 1 according to the invention. The waveguide 1 according to FIG. 1 comprises three matching means 2 and a housing 3 partly encompassing three cavities 4. The housing 3 is mounted onto a conductive surface 5 of a carrier 6 forming a wall 7 closing the cavity 4. The matching means 2 is in the form of a volume element. Each enclosed cavity 4 has a predetermined first volume and the corresponding matching means 2 has a predetermined second volume being matched to the first volume forming a predetermined volume to volume ratio. Each matching means 2 is fitted into the corresponding cavity 4 in a fixed non-adjustable manner in relationship to the housing 3 and the wall 7. The invention is of course not limited to the use of three cavities, but may comprise any number of cavities ranging from 1 and up.

FIG. 1 shows that the carrier 6 surface 5 is partly coated with a positioning means 8. The positioning means 8 is in the form of a ring and the matching means 2 is positioned in the centre of the ring.

FIG. 1 shows that the housing 3 comprises an input port 9 and an output port 10 for receiving and transmitting a microwave signal. The housing 3 in FIG. 1 also comprises four side walls 11, a top wall 12, and two partition walls 13. The partition walls 13 are positioned in the housing such that they delimit a space in the housing and thereby forming the three cavities 4. Each partition wall 13 comprises an intermediate port 14 for guiding the signal in a direction from the input port 9 to the output port 10 via the matching means 2.

The volume to volume ratio is chosen dependent on the use of the waveguide filter, i.e. if it is to be used as a band-pass filter, low-pass or high-pass filter. Furthermore, the second volume and thus the volume to volume ratio depends on a number of parameters, namely: the material in the matching means 2; the position of the matching means 2; the shape of the matching means 2; the dielectric constant of the matching means 2; and the position and size of the input port 9, output port 10 and the intermediate ports 14.

FIG. 1 shows that the housing 3 comprises a cavity 4 with a square base with a width W0 a length L. FIG. 1 also shows that the in-port 9 has a width W1 and that the out-port 10 has a width W2. Furthermore, the matching means 2 have been depicted with different heights ht in the different cavities. This is only to show that the volume to volume ratio may easily varied according to the invention by simply using different matching means 2 with different heights.

Figure 2:
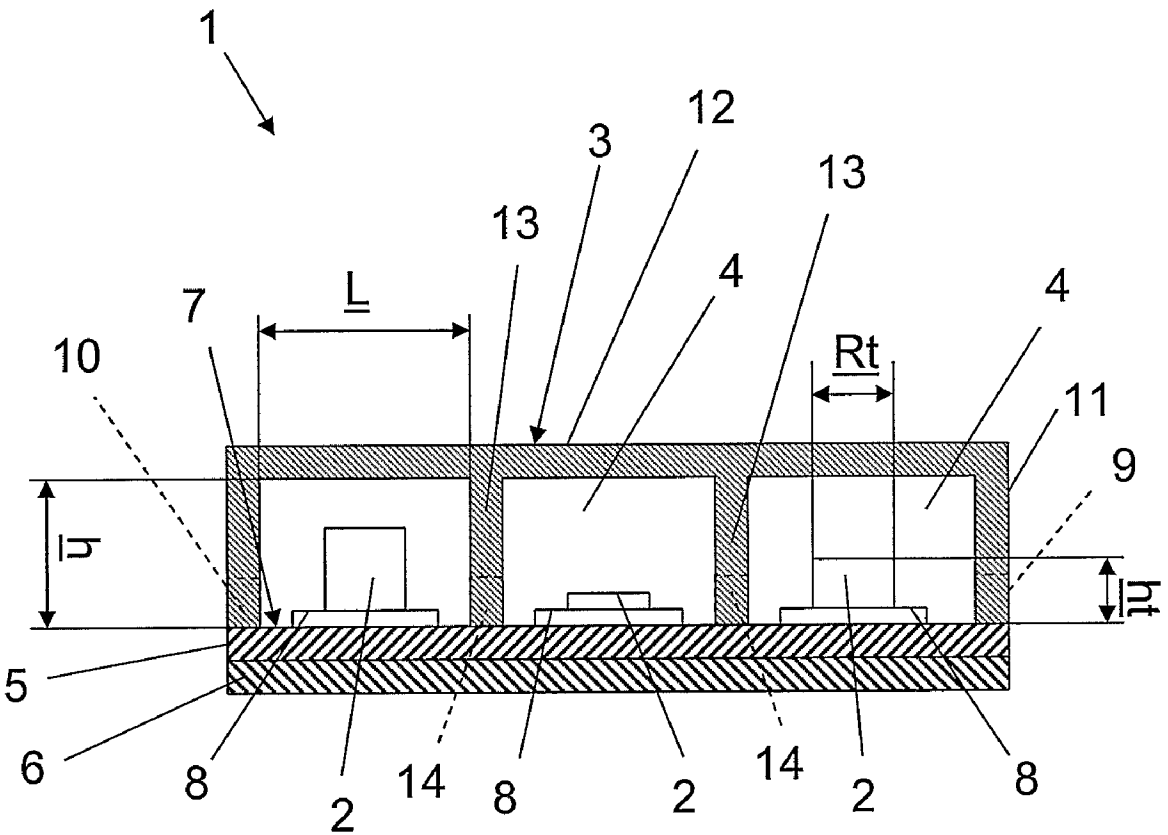
FIG. 2 schematically shows a cross-sectional side view along line A-A in FIG. 1 of a waveguide filter according to a first embodiment of the invention, and where.

FIG. 2 schematically shows a cross-sectional side view along line A-A in FIG. 1 of a waveguide filter according to a first embodiment of the invention. FIG. 2 shows that the housing 3 and each cavity 4 have a rectangular cross-section where the cavity has a height h. The invention is not limited to cavities 4 being square or rectangular, but other shapes are possible for generating a standing wave. FIG. 2 shows that the matching means 2 are in the form of cylindrical elements having a radius Rt and being attached to the surface 5 of the carrier 6. The matching means may of course have other forms, for example cone shaped, pyramidal, spherical, ellipsoidal, cylindrical, or any other shape suitable for the stated purpose of matching in a waveguide filter The matching means 2 are, in FIG. 2, in the form of solid objects being attached directly onto the surface 5 by a suitable method, for example the use of an adhesive or by soldering.

FIG. 2 shows that the positioning means 8 has a height and thus a volume that has to be taken into consideration when calculating the volume to volume ratio between the first volume and the second volume. It is possible to consider the volume of the positioning means 8 being part of either the first volume or being a part of the second volume. However, when deciding the volume of the positioning the same parameters have to be taken into consideration as when deciding the second volume, i.e. the position, the material and the form.

Below is an example of a waveguide band-pass filter for a 23 GHz signal and a corresponding band-pass width. In order to simplify the description of the example, the example is described with reference to FIGS. 1-2. The example shall not be seen as limiting for the invention, but the invention may be varied within the scope of the claims.

h=4 mm; ht=0-5 mm; L=6-9 mm; W0=2-4 mm; W1=W2=10.7 mm; rt=1-3 mm

For these parameters, the waveguide filter 2 performs as a band-pass filter with a predetermined band-pass width dependent on ht, L and W0.

Figure 3:
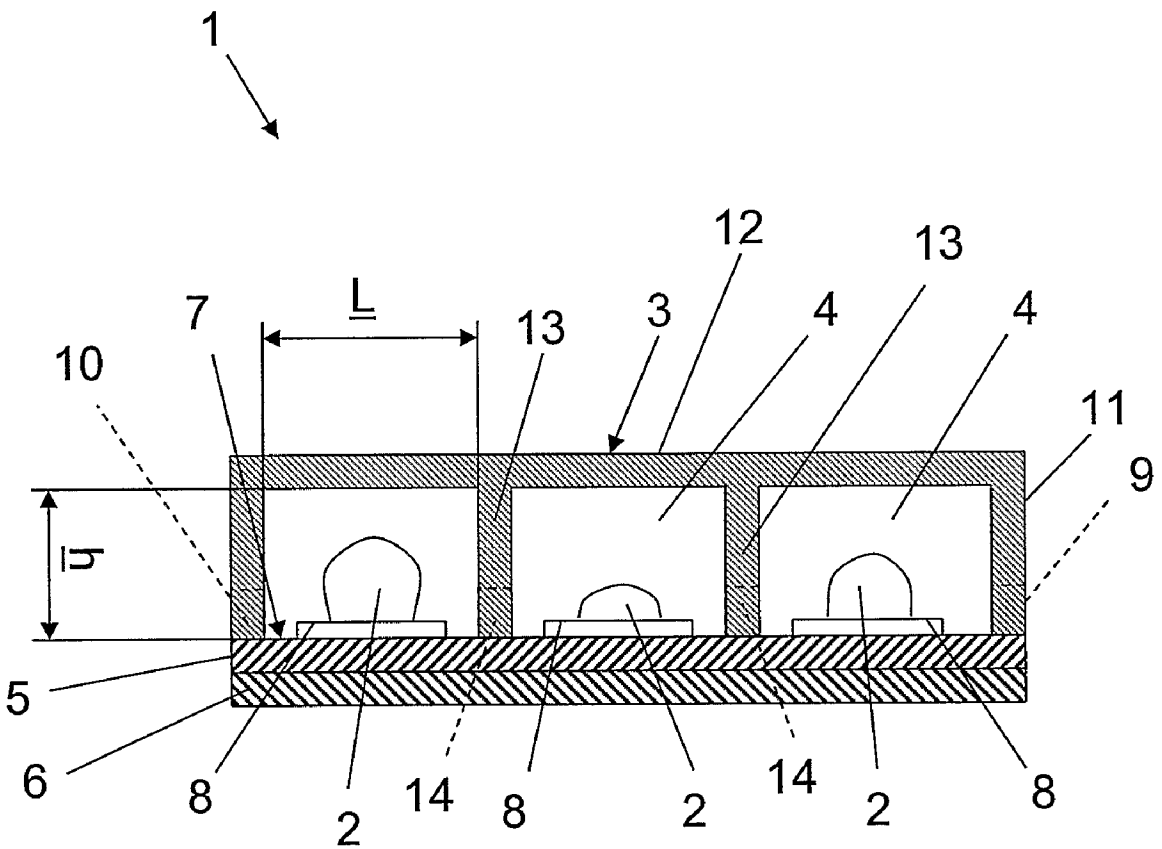
FIG. 3 schematically shows a cross-sectional side view of along line A-A in FIG. 1 of a waveguide filter according to a second embodiment of the invention.

FIG. 3 schematically shows a cross-sectional side view of along line A-A in FIG. 1 of a waveguide filter according to a second embodiment of the invention. FIG. 3 is identical to FIG. 2 apart from the matching means that have different form than in FIG. 1. The matching means in FIG. 3 is manufactured by use of a solidifiable liquid which has been positioned onto the carrier 5 surface 6 in its liquid form. The liquid has then solidified into a solid state. In FIG. 3 the matching means 2 are dome shaped due to the fact that the surface tension of a liquid together with the gravity automatically gives such a form. The matching means may of course have other forms when using a different manufacturing process, for example cone shaped, pyramidal, spherical, ellipsoidal, cylindrical, or any other shape suitable for the stated purpose of matching in a waveguide filter. In FIG. 3 the matching means 2 are shown with different sizes for the same reason as in FIG. 2.

The invention is not limited to the embodiments in FIGS. 1-2, but may be varied within the scope of the claims. For example, the matching means may be attached to the inside surface of the housing and the positioning means may then be applied onto the inside surface accordingly.

The invention claimed is:

1. A waveguide filter comprising:

a housing having a cavity with a predetermined first volume;

a matching means in the form of a volume element having a predetermined second volume being matched to the first volume forming a predetermined volume to volume ratio, wherein the matching means is fitted into the cavity in a fixed non-adjustable manner in relationship to the housing, and the matching means is in the form of a solidified object being attached to the housing by the solidified object being formed into the housing surface in liquid form and then being solidified.

2. The waveguide filter according to claim 1, wherein the housing partly encompasses the cavity, the housing being mounted onto a conductive surface of a carrier forming a wall closing the cavity.

3. The waveguide filter according to claim 2, wherein the matching means is directly attached to the carrier surface.

4. The waveguide filter according to claim 2, wherein the matching means being attached to the carrier surface via attachment means being part of the second volume of the matching means.

5. The waveguide filter according to claim 1, wherein the matching means being attached to the housing via attachment means being part of the second volume of the matching means.

6. The waveguide filter according to claim 2, wherein the carrier surface is partly coated with a positioning means for hindering the liquid from exiting a predetermined area.

7. A method for manufacturing a waveguide filter having a matching means for matching the filter, the method comprises the steps of:

manufacturing a housing separate from the matching means;

forming the housing to have a cavity having a predetermined first volume;

forming a matching means in the form of a volume element having a predetermined second volume being matched to the first volume forming a predetermined volume to volume ratio, wherein the matching means is formed as a solidified object attached to the housing by being formed onto the housing surface in liquid form and then being solidified; and fitting the matching means into the cavity in a fixed, non-adjustable manner in relationship to the housing.

8. The method for manufacturing a waveguide filter according to claim 7, wherein the housing partly encompasses the cavity and is mounted onto a conductive surface of a carrier forming a wall closing the cavity.

9. The method for manufacturing a waveguide filter according to claim 8, wherein the matching means is directly attached to the carrier surface.

10. The method for manufacturing a waveguide filter according to claim 8, comprising the further steps of:

attaching the matching means to the carrier surface via an attachment means being part of the second volume of the matching means.

11. The method for manufacturing a waveguide filter according to claim 7, wherein the matching means attached to the housing via an attachment means being part of the second volume of the matching means.

12. The method for manufacturing a waveguide filter according to claim 8, wherein the carrier surface is partly coated with a positioning means for hindering the liquid from exiting a predetermined area.

* * * * *